US008736459B2

(12) United States Patent
Ouellet

(10) Patent No.: US 8,736,459 B2
(45) Date of Patent: May 27, 2014

(54) CONTROL SYSTEM AND METHOD OF OPERATING A BACK-AND-FORTH CABLE SYSTEM

(76) Inventor: Jean-Michel Ouellet, Maple Grove (CA)

( * ) Notice: Subject to any disclaimer, the term of this patent is extended or adjusted under 35 U.S.C. 154(b) by 629 days.

(21) Appl. No.: 13/027,927

(22) Filed: Feb. 15, 2011

(65) Prior Publication Data

US 2012/0038485 A1 Feb. 16, 2012

(30) Foreign Application Priority Data

Mar. 19, 2010 (CA) ..... 2696927

(51) Int. Cl.

| | |
|---|---|
| ***G08B 21/00*** | (2006.01) |
| ***B61B 7/00*** | (2006.01) |
| ***B66C 21/00*** | (2006.01) |
| ***B66C 21/04*** | (2006.01) |
| ***B66C 21/02*** | (2006.01) |

(52) U.S. Cl.

CPC ..... *B66C 21/00* (2013.01); *B66C 21/04* (2013.01); *B66C 21/02* (2013.01)

USPC ..... 340/668; 340/673; 340/677; 104/112; 212/73; 212/76; 212/77; 212/86; 212/329

(58) Field of Classification Search

None

See application file for complete search history.

(56) References Cited

U.S. PATENT DOCUMENTS

| | | | | |
|---|---|---|---|---|
| 1,546,031 | A | 7/1925 | Schofield | |
| 3,052,470 | A | 9/1962 | Pomagalski | |
| 3,080,164 | A | 3/1963 | Davis | |
| 3,376,829 | A | 4/1968 | Hancock | |
| 4,082,193 | A * | 4/1978 | Teague | 414/22.52 |
| 4,310,283 | A * | 1/1982 | Teague | 414/800 |
| 4,523,525 | A | 6/1985 | Foster | |
| 5,072,534 | A * | 12/1991 | Kodet | 40/524 |
| 6,937,911 | B2 * | 8/2005 | Watson | 700/60 |
| 8,166,886 | B2 * | 5/2012 | Thum | 104/197 |

* cited by examiner

*Primary Examiner* — Julie Lieu

(74) *Attorney, Agent, or Firm* — Baker & Hostetler LLP

(57) ABSTRACT

A control system and a method for a back-and-forth cable system is provided. The cable system includes a running cable, a first pulley and a second pulley, the pulleys being located at both ends of a course for guiding the running cable. A controllable motor assembly drives of the pulleys and a carrier is connected to the running cable, for pulling or towing a boarder. The control system includes first and second tracking devices to generate first and second tracking signal indicative of the rotation of the pulleys. Two limit positions along the course are stored in storing means and a controller has inputs to receive the first and the second tracking signals and inverts rotation of the controllable motor assembly when the two positions of the carrier detected go beyond either one of the two limit positions.

22 Claims, 8 Drawing Sheets

CONTROL SYSTEM AND METHOD OF OPERATING A BACK-AND-FORTH CABLE SYSTEM

CROSS-REFERENCE TO RELATED APPLICATIONS

This application claims priority to foreign Patent Application CA 2696927, filed on Mar. 19, 2010, the disclosure of which is incorporated herein by reference in its entirety.

FIELD OF THE INVENTION

The present invention relates to the field of back-and-forth cable system. More particularly, it concerns a control system and a method of operating a back-and-forth cable system.

BACKGROUND OF THE INVENTION

Back-and-forth cable systems are typically used for the practice of wakeboarding. They generally include two towers, a motor, a running cable extending between the towers and a carrier connected to the cable, for towing or pulling a boarder over a water area. In opposition to cableway systems, which enable several boarders to ride at the same time, and where the cable forms a loop running in a single direction, back-and-forth cable system are generally used for pulling one boarder at a time, the cable changing direction at the end of each course, in order for the carrier to move back-and-forth between the two towers.

A problem with existing systems is the difficulty to manage problems related to the cable, such as slippage of the cable over the pulleys, stretching of the cable, and especially lateral stretching, inadequate tensioning, etc. These problems make it difficult to precisely locate the carrier over a given course between the towers. Being able to locate the carrier precisely over the course is required for establishing the turning points, that is, the limit positions at which the carrier will change direction.

Slippage and lateral stretching of the cable is not an issue in cableway systems since such systems do not need determine precisely the position of the carrier: the carrier is moved continuously in the same direction and the rotation of the shaft of the motor is not stopped and inverted when in operation, such as required with back-and-forth system.

Some of the existing back-and-forth systems use motor encoders in order to determine the location of the carrier between the towers; however, an encoder cannot take account of slippage or stretching of the cable. The cable of a back-and-forth system can be suddenly tensioned and pulled away from their linear path since wakeboarders usually slalom and zigzag over the water surface, or jump over platforms and obstacles placed along the course, thereby stretching the cable laterally.

Another drawback of existing back-and-forth cable systems is the difficulty to easily and securely control their operation. The motor is generally controlled by means of a potentiometer which must be turned manually in order to vary the speed of the motor. Since the control is done manually, the acceleration of the carrier, the cruising speed and the position of the turning points are not steady or repeatable throughout a wakeboarding session, which is not ideal.

Another drawback of most existing back-and-forth cable system is the necessity to have access to an industrial 460V power line in order to power the system. The few existing systems which can be used with a 220V power line require cumbersome transformer or transducer for converting the single phase 220V line to a three-phase line.

In light of the above, there is a need for a control system and for a method of operating a back-and-forth cable system which are secure for both the rider and the operator. There is also a need for an automated back and forth cable system which provides a smooth, secure and predictable ride for the boarders.

SUMMARY OF THE INVENTION

The present invention advantageously provides a control system and a method of operating a back-and-forth cable system that satisfies at least one of the above-mentioned needs.

In one embodiment of the present invention, a control system for a back-and-forth cable system includes a running cable, a first pulley and a second pulley, said pulleys being located at both ends of a course for guiding the running cable, a controllable motor assembly for driving one of the pulleys and a carrier connected to the running cable.

This control system comprises:

- a first tracking device associated with the first pulley, for generating a first tracking signal indicative of a rotation of said first pulley; and
- a second tracking device associated with the second pulley, for generating a second tracking signal indicative of a rotation of said second pulley;
- storing means for storing a first and a second limit positions along the course; and
- a controller having inputs for receiving the first and the second tracking signals which are representative of positions of the carrier, said controller generating a control signal to invert rotation of the controllable motor assembly when said two positions of the carrier detected respectively by the first and second tracking devices go beyond either one of the two limit positions.

Preferably, the controller further comprises two position counters, each of said position counters being associated with a corresponding one of the positions of the carrier, the controller resetting the position counters when said two positions of the carrier go beyond either one of the first and second limit positions There is also provided a back-and-forth cable system comprising the control system described above, first and second towers, the running cable, the first pulley which is mounted on the first tower, the second pulley which is mounted on the second tower; and the controllable motor assembly. Preferably, the controllable motor assembly includes a 220V motor drive.

In accordance with another aspect of the present invention, a method for operating a back-and-forth cable system including a running cable and pulleys located at both ends of a course for guiding the running cable, a controllable motor assembly for driving one of the pulleys and a carrier connected to the running cable is provided.

This method comprises the steps of:

a) generating a first tracking signal indicative of a rotation of said first pulley and representative of a first position of the carrier;

b) generating a second tracking signal indicative of a second position of the carrier and representative of a second position of the carrier;

c) storing a first limit position and a second limit position along the course; and generating a control signal to invert a rotation of the controllable motor assembly when said positions of the carrier according to steps a) and b) go beyond either one of the limit positions, stored in step c).

Preferably, the method further comprises the steps of resetting the first and the second positions when said two positions of the carrier go beyond either one of the first and second limit positions.

Advantageously, the control system facilitates and renders more secure the operation of the back and forth system. It allows for a better control of the turning points by taking into account slippage and lateral stretching that might occur.

By rotation of the pulley, it is meant the angular displacement of the pulley, in a clockwise or counter-clockwise direction.

By rotation of the motor, it is meant the rotation of a shaft of the motor driving one of the pulleys.

By limit positions, it is meant the positions at which the carrier is set to change direction. The limit positions determine the path along which the carrier is to move such as when pulling or towing a rider.

BRIEF DESCRIPTION OF THE DRAWINGS

These and other objects and advantages of the invention will become apparent upon reading the detailed description and upon referring to the drawings in which.

DETAILED DESCRIPTION OF THE INVENTION

Figure 1:
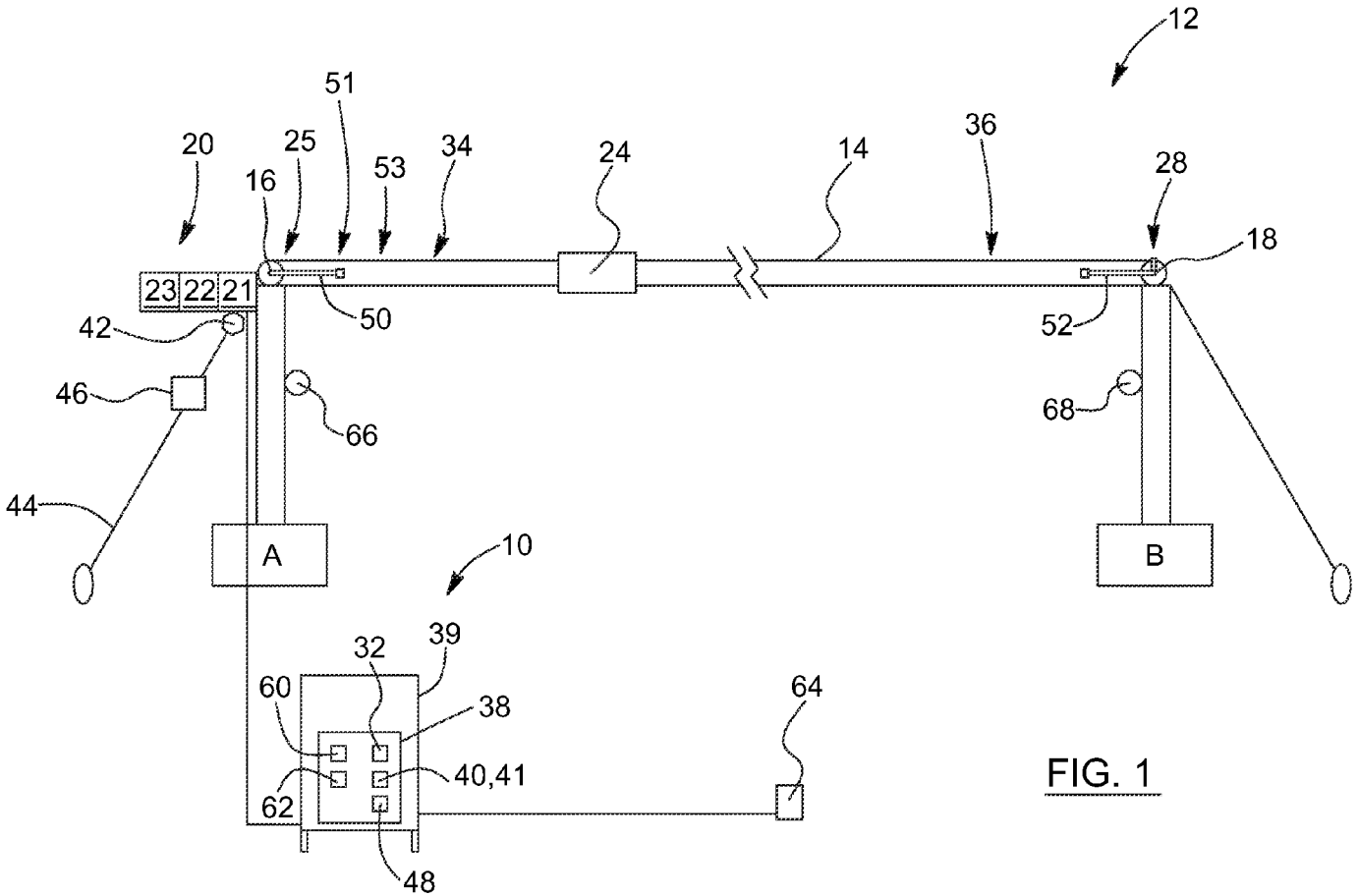
FIG. 1 is schematic view of a back-and-forth cable system with a control system, according to an embodiment of the invention.

In the following description, similar features in the drawings have been given similar reference numerals and in order to way down the figures, some elements are not referred to in some figures if they were already identified in a preceding figure.

Lately, there has been a need for the practice of aquatic sports and activities with greater environmental respect, where pollution of water, air and water shores can be reduced or eliminated. The control system of the invention aims at pulling or towing wakeboarders and water-skiers, with small electricity consumption and with limited water or air pollution. In addition, in regions where weather conditions allow it, this system aims at allowing the practice of snowboarding or snow-skiing on flat surfaces covered with snow, such as on iced lakes.

With reference to FIG. 1, a control system 10 for a back-and-forth cable system 12 is shown. The back and forth cable system 12 includes a running cable 14, a first pulley 16 and a second pulley 18, said pulleys 16, 18 being located at both ends of a course for guiding the running cable 14. A controllable motor assembly 20 drives one of the pulleys, in this case the first pulley 16. The controllable motor assembly 20 is formed by a gear motor 21, a drive 22 and a motor brake 23. Of course, other combinations can be considered, as long as operation of the motor can be controlled. For example, in other embodiments of the invention, the assembly can include only a drive and a motor. A carrier 24 is connected to the running cable 14. Not shown in the figures, a towing cable and tow bar is attached to the carrier, the rider holding the tow bar when being pulled by the cable system 12.

The control system 10 includes a first tracking device 25 associated with the first pulley 16, in order to generate a first tracking signal indicative of the rotation of the first pulley 16. The control system 10 also includes a second tracking device 28 associated with the second pulley 18, in order to generate a second tracking signal indicative of the rotation of the second pulley 18. The rotation of each pulley provides information on the direction in which the carrier is being moved, and also on the speed and acceleration of the carrier. Using this information it is possible to determine or estimate a position of the carrier based on the rotation of each one of the pulleys.

The control system 10 also includes storing means 32 for storing a first limit position 34 and a second limit position 36 along the course. These limit positions 34, 36 correspond to the actual locations where the carrier is to change direction. They are can also be referred to as "turning points" since they correspond to the locations where the rider or boarder needs to turn in order to continue its ride in the other direction.

The control system 10 also includes a controller 38. The controller 38 is preferably a programmable logic controller (PLC), but other types of controller can also be considered, such as a PC, or a PLC module integrated in the drive 23 of the controllable motor assembly 20. In this preferred embodiment, the storing means 32, such as a compact flash memory for example, are part of the controlling, but other arrangements are possible. The controller can of course access and modify the values stored in the storing means.

Figure 1A:
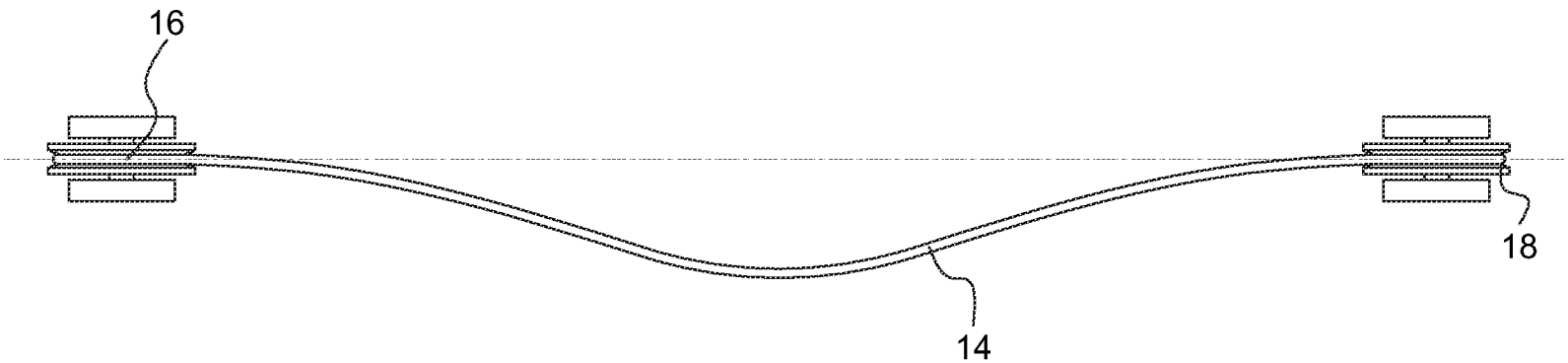
FIG. 1A is a schematic top view of the back-and-forth system of FIG. 1, showing the running cable stretched laterally.

The controller 38 has inputs in order to receive the first and the second tracking signals from the respective tracking devices, the signals being representative of positions of the carrier. In other words, each tracking device 25, 28 tracks a position for the carrier. Since the cable can slip at the driven pulley 16, or can be stretched laterally, as shown in FIG. 1A, when being pulled by a rider, the tracking device 25 may track a position of the carrier which is different then the position tracked by the second tracking device 28. In other words, the pulleys 16, 18 may not always turn at the same rate, and moreover, the running cable may not always move at the corresponding rate of the driving pulley. This is why two positions of the carrier are determined during its displacement, these two positions corresponding to the ones as viewed or detected by the two tracking devices 25, 28.

The controller generates a control signal to invert the rotation of the controllable motor assembly 20 when both positions of the carrier 24, detected respectively by the first and second tracking devices 25, 28, go beyond either one of the two limit positions 34, 36. For example, if the carrier is approaching tower A, the controller will wait until both signals received from the tracking devices indicate that the positions of the carrier have passed the first limit position 34 before inverting the rotation of the shaft of the motor 21, so that the carrier can be directed towards tower B. Of course, in addition to inverting the rotation of the shaft of the motor, the controller can also decelerate the rotation prior the inversion so that the change of direction is done smoothly.

In order to do so, the control system 10 includes two position counters 40, 41, each of said position counters 40, 41 being associated with a corresponding position of the carrier. In other words, the position counter 40 keeps count of the displacement or position of the carrier based on the tracking signal emitted from the tracking device 25 located at tower A, and the position counter 41 keeps count of the position of the carrier based on the tracking signal emitted from the tracking device 28 located at tower B. The controller resets the position counters 40, 41 when the two positions of the carrier go beyond either one of the limit positions 34, 36. This is done in order to prevent the difference between the positions of the carrier 24 from continuously incrementing during the course of a wakeboarding session. Putting both counters 40, 41 to zero once positions of the carrier 24 have passed a limit position 40 or 41 ensures that the positions of the carrier 24 as viewed by each of the tracking device 25, 28 are the same at the beginning of each run between the two towers.

Still referring to FIG. 1, the control system 10 includes a tension sensor 42 associated with a tension cable 44 of the back-and-forth system 12 for monitoring the tension that cable 44. Within the storing means 32, a first predetermined tension threshold $T_{min1}$ is stored. The tension sensor 42 is provided with an output to send a tension signal indicative of the tension of cable 44. The controller 38 has an input to receive the tension signal and an output to generate an alarm signal when the tension is below $T_{min1}$. Another threshold $T_{max1}$ is also stored within the storing means 32, such that when the tension of the tension cable is above this $T_{max1}$ threshold, the controller generates an alarm signal to indicative that the cable is over-tensioned. In FIG. 1, only one tension cable is shown at tower A, however tower B could also be provided with a tension cable and a tension sensor.

The control system 10 further includes a controllable tensioner 46 for tensing the tension cable of the back-and-forth system when required. By tensioner 46, it is meant any means to adjust the tension within the tension cable. Within the storing means 32, a second predetermined tension threshold $T_{min2}$ is saved. The controller 38 is provided with an output to send a tension control signal, and the tensioner 46 is provided with an input to receive such tension control signal. The controller 38 sends a tensing control signal to the tensioner 46 when the tension of tension cable 44 is below $T_{min2}$, in order to increase the tension of cable 44. Of course, the tension of the cable 44 is indicative of the tension in the running cable. When the tension of cable 44 is increased, the tension is the running cable 14 is also increased. In addition, it is also possible to have the tension sensor 42 incorporated in the tensioner 46. In FIG. 1, the tension cable 44, tension sensor 42 and tensioner 46 are only shown on tower A, however, tower B can also be provided with such components.

Of course, another threshold $T_{max2}$ can be saved in the storing means 32. When the tension detected by the tension sensor exceeds $T_{max2}$, the controller sends a signal to the tensioner 46 to decrease the tension of the tension cable 44, thus reducing the tension in the running cable. Variation of tension in the running cable can occur for various reasons, the most common being due to temperature changes.

In order to facilitate the management of the cable system, and for allowing the operator to focus his attention on the rider, a duration limit is stored within the storing means 32. The controller is provided with a duration counter 48 in order to keep track of the time elapsed since the controllable motor assembly 20 is in operation. The controller generates a control signal to stop the rotation of the motor when the time elapsed since the beginning of a session is equal to the duration limit.

To facilitate the management of the cable system, predetermined values or parameter related to the different sequences of a training session can be used. An acceleration A, a speed S and a deceleration D, along with three time periods $t_a$, $t_s$ and $t_d$, respectively associated with acceleration A, speed S and deceleration D are saved within the storing means 32. The controller 38 generates a control signal to vary the rotation of the controllable motor assembly 20 so that the controllable motor assembly accelerates at a rate A during the time period $t_a$, turns with said speed S during the time period $t_s$ and decelerates at a rate D during a time period $t_d$. In other words, a wakeboarding session can be completely automated, the controller 38 adjusting the rotation of the motor, and consequently the displacement of the carrier 24, according to predetermined parameters. The ride, from the beginning to the end, can be controlled automatically, within requiring any intervention from an operator.

Figure 2:
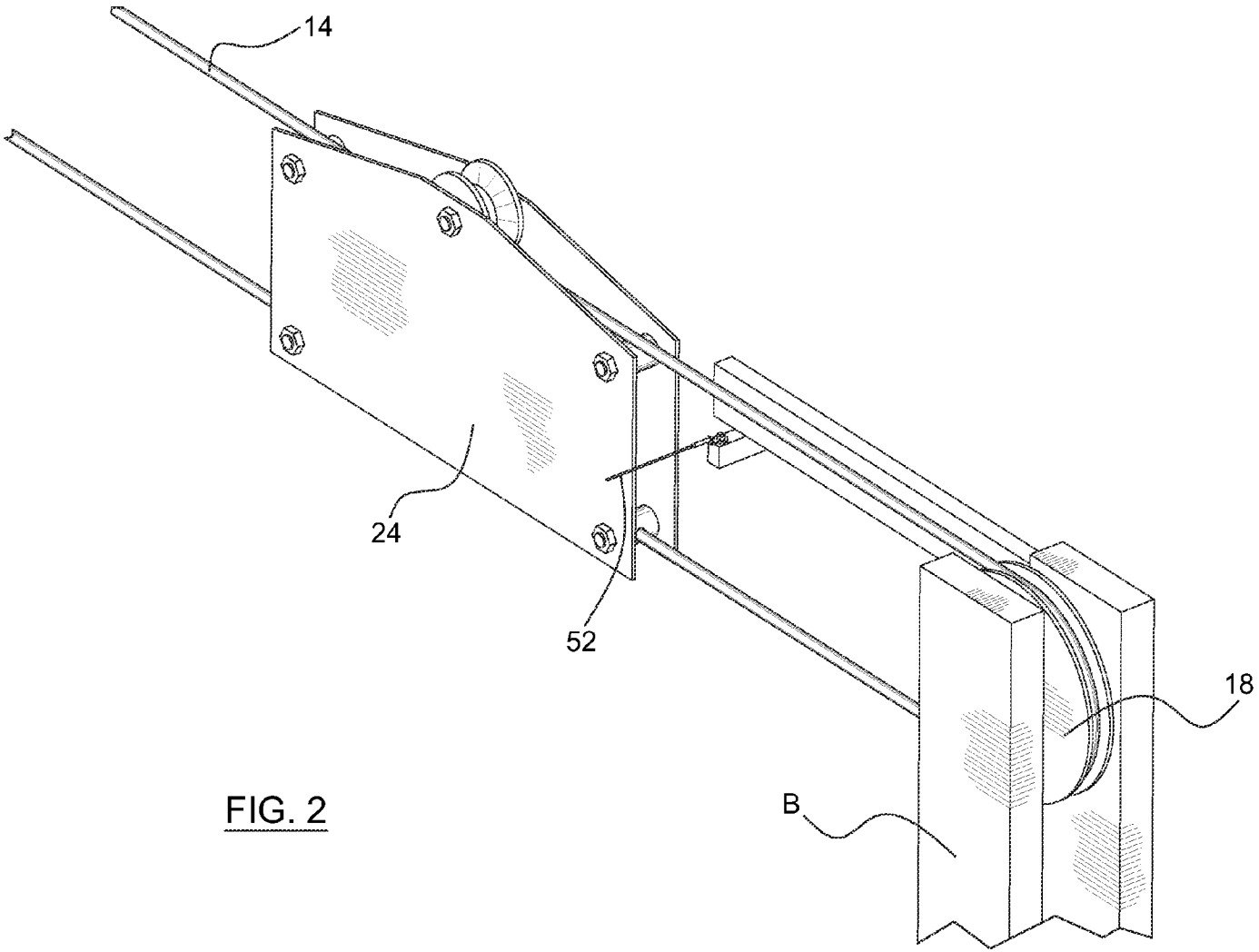
FIG. 2 is a partial perspective view of a detector of the control system of FIG. 1.

Referring now to FIGS. 1 and 2, the control system 10 further includes a first detector 50 and second detector 52 for detecting the presence of the carrier 24. These detectors are used in order to detect if the carrier goes too far beyond any of the limit positions, in case of a malfunction of the cable system for example. The first detector 50 is located near tower A, between the first pulley 16 and the first limit position 34, while the second detector 52 is located between the second pulley 18 and the second limit position 36. The controller will send a control signal to the controllable motor assembly in order to stop the rotation of the motor when the carrier is detected by either one of the detectors 50, 52.

Figure 3:
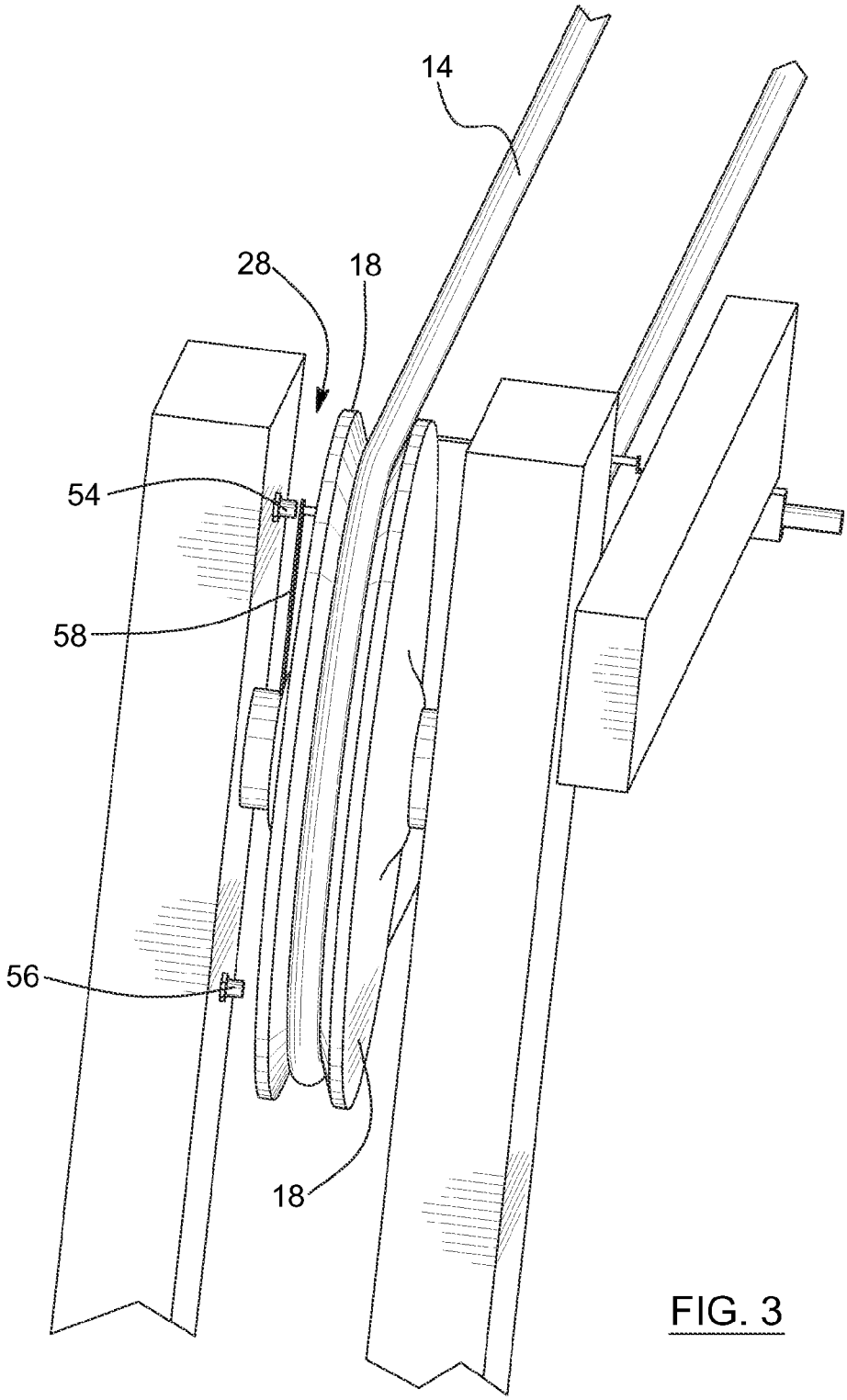
FIG. 3 is a partial perspective view of a tracking device of the control system of FIG. 1.

Now referring to FIGS. 1 and 3, the first and second tracking devices 25, 28 each includes a first proximity detector 54, a second proximity detector 56 and a metal strip 58. While FIG. 3 only shows the second tracking device 28 of the second pulley 18 of tower B, the first tracking device 25 of the first pulley 16 of tower A is built in the same fashion. As shown in FIG. 3, the first and second proximity detectors 54, 56 are mounted on a frame supporting the pulley 18 and the metal strip 58 is affixed directly on the pulley 18.

In operation, at tower A, the first tracking signal of tracking device 25 forms a pulse P1 when the first detector 54 of tower A detects the corresponding metal strip 58, and a pulse P2 when the second detector 56 detects the metal strip 58. Similarly, at tower B, the second tracking signal forms a pulse P3 when the first detector of the second tracking device 28 detects the metal strip 58 and a pulse P4 when the second detector 56 detects the metal strip 58. This construction of the tracking device is particularly advantageous since it allows the detection of "false pulses". Using two sensors allows the controller to wait for a predetermined sequence, for example P1-P2-P1, prior to determining that the pulley completed a rotation. When only one sensor is used, and the metal strip stop near the detection limit of the sensor, the sensor could generate several pulses while in reality, the pulley is idle. The use of two sensors 54, 56 allows overcoming such problem. Of course, other means could be considered, such as quadrature encoders for example.

The controller 38 includes a monitoring module 60 in order to monitor the first and second tracking signals, and means 62 to detect an anomaly on the first and second tracking signals. The controller 38 generates a control signal to the controllable motor assembly 20 to stop the motor 21 when such an anomaly is detected on either one of the tracking signals. This characteristic of the controller provides a safer operation of the cable system, since the displacement of the carrier, and thus the rider, is based on the detecting signals.

Figure 4:
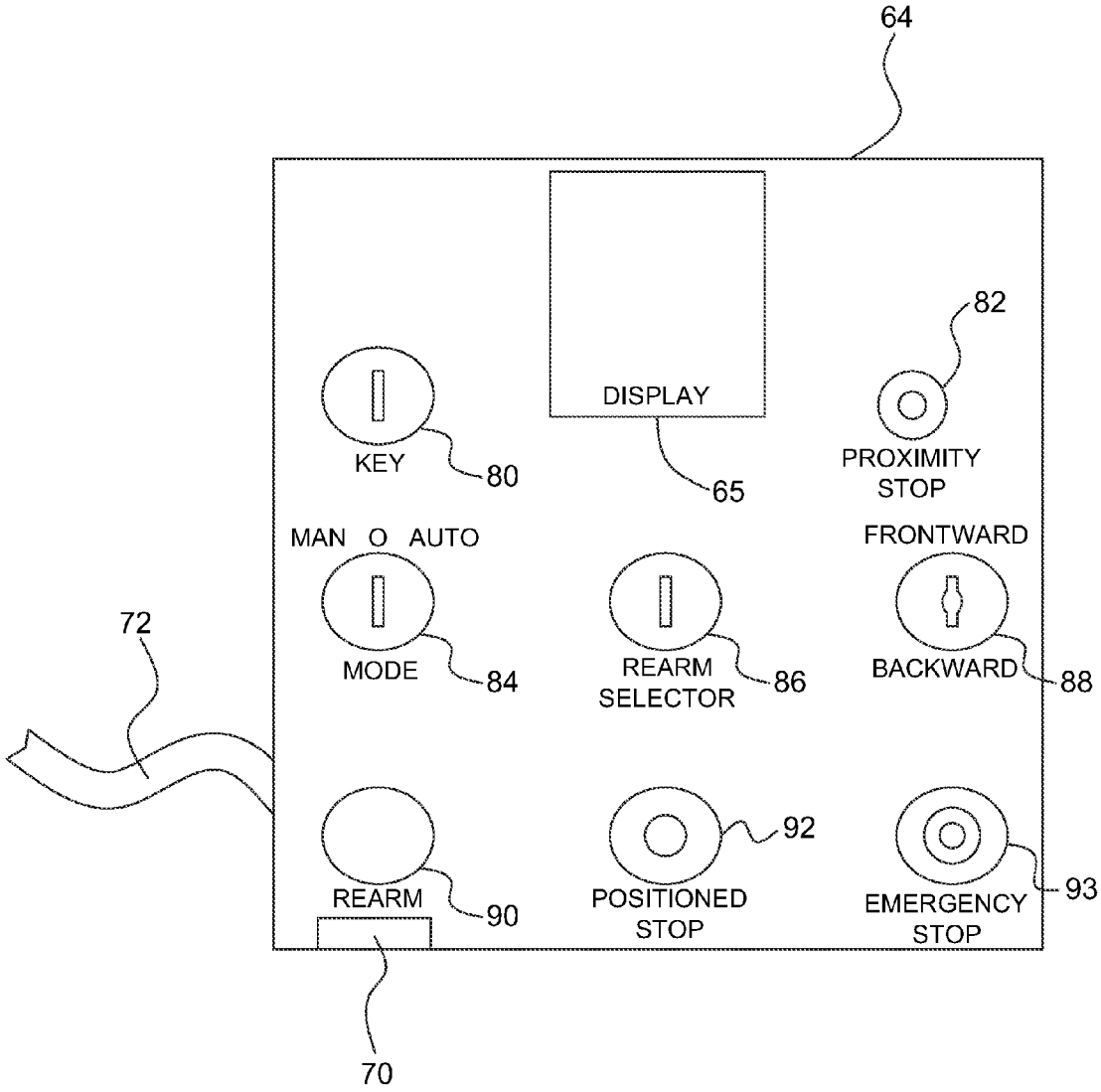
FIG. 4 is a schematic view of the control console of the control system of FIG. 1.

Now referring to FIGS. 1 and 4, the control system 10 includes a control console 64 connected to the controller 38 and thus to the storing means 32, in order to allow a user or operator to modify values stored in the storing means. Such values are for example the limit positions 34 and 36, the tension threshold $T_{max1}$, $T_{max2}$, $T_{min1}$, $T_{min2}$, the acceleration A, speed S, and deceleration D, along with their associated time periods ta, ts and td, the duration limit for a session, and any other parameters stored in the storing means 32 and related to the operation of the cable system. The control console thus allows a user or operator to access the controller in order to change and adjust the operation of the back-and-forth cable system.

With reference to FIG. 4, the control console is provided with a speaker 70, for generating a sound signal. It is the controller 38 that controls the speaker 70 by generating a sound control signal to the speaker 70, such as when the controllable motor system assembly 20 is put in operation. A short sound signal is emitted when the control system 10 controls automatically the riding session, in order to inform the operator of an imminent departure of a rider. Sound signal can also be generated in case of a fault, such as when the tension detected on the tension cable is inadequate for proper operation of the cable system.

Still referring to FIG. 4, the control console is further provided with a security cable 72 connectable between the operator and the control console 64. In order to make sure the operator is close to the console when the system is in operator, the controller 38 will generate a control signal to stop the controllable motor assembly 20 when the security cable 72 is no longer connected to the console 64.

With reference to FIG. 1, the control system 10 includes two signalling lights 66, 68 located respectively at said both ends of the course. The controller 38 generates an ON signal to the corresponding one of the two signalling lights towards which the carrier is heading. This is particularly helpful for the rider after a fall, since the signalling light will indicate him in which direction the carrier is going to move, so that he can prepare himself accordingly.

Referring now to FIGS. 1 to 4, the preferred embodiment of the control system 10 includes a motor drive 23, a of sensors 54, 56 at each tower, two detectors 50, 52, two metals strips, one at each tower, at least one tension sensor 42, two 220 volts signalling lights 66,68, an electrical panel 39 and a control console 64.

In this preferred embodiment of the invention, the electric panel 39 is installed at about a hundred feet from the departure tower A. This electric panel 39 is powered by a 220V entry with a circuit breaker of 40 A and a ground. The control console 64 is connected to the electric panel 39, and is preferably located no more than a hundred feet away from the electric panel 39, using the security or proximity cable 72. Four sensors are divided in two groups, corresponding to each tower: sensors 54 and 56 located on tower A and sensors 54 and 56 located on tower B. These sensors are affixed on the frame supporting the pulleys 16, 18. The metal strips 58 are each affixed on a corresponding pulley. The motor drive 23 is installed near the top of tower A (which is the "driving" tower). Specific ratio and HP for the motor assembly 20 can be determined according to the particularities of each site and according to the type of application. Preferably, a motor brake 22 is integrated to the motor 21 and powered by a 220 voltage. The detectors 50, 52 are located at both ends of the course for security purposes. They are respectively located on tower A and B, and preferably at an approximate distance of 12 feet (3.7 meters) from the pulleys. A tension sensors 42 is installed near the top of the towers, between tension cable 44 and the connecting point of this cable.

Figure 6:
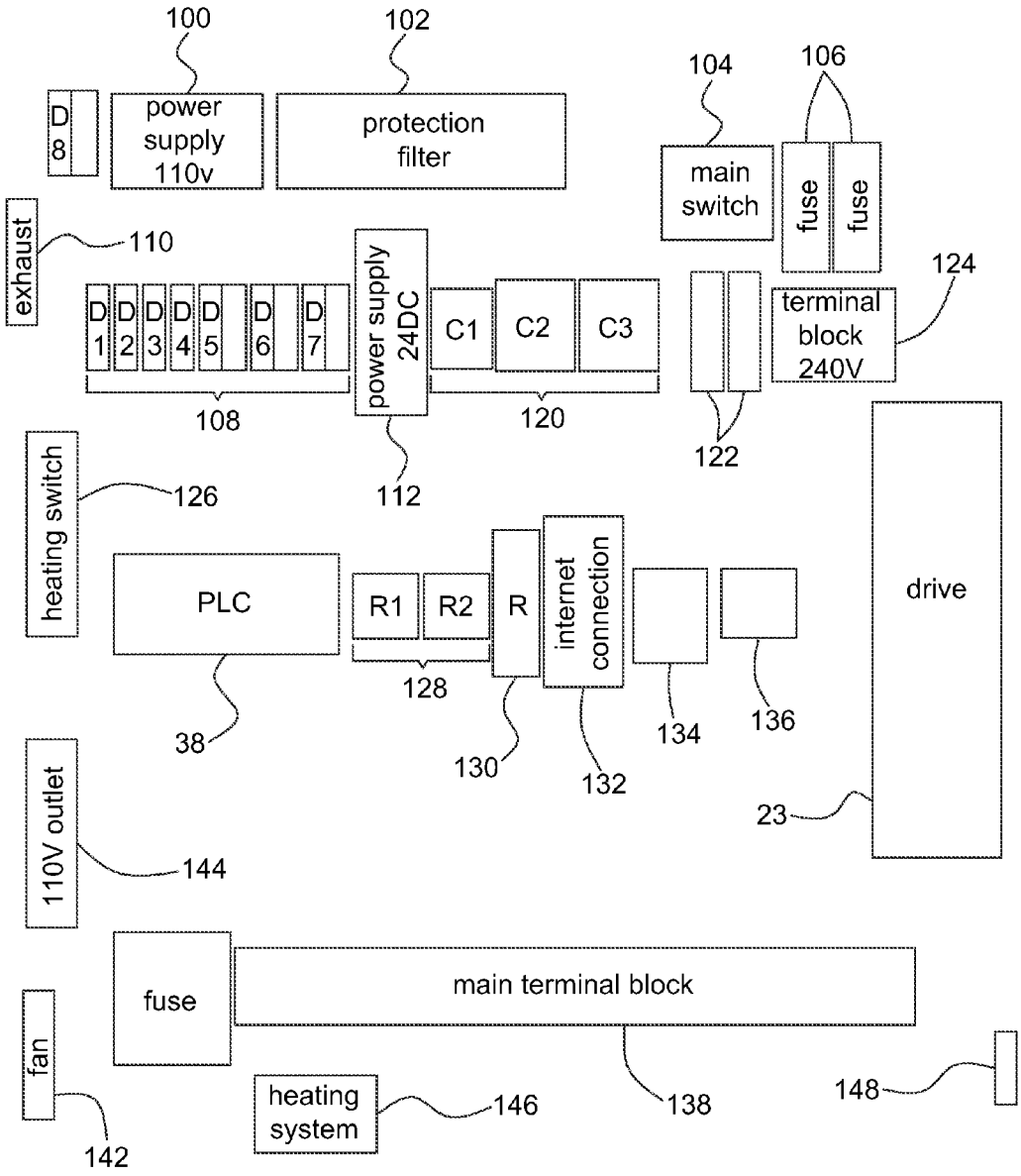
FIG. 6 is a schematic view of the electric panel of the control system of FIG. 1.
Figure 7:
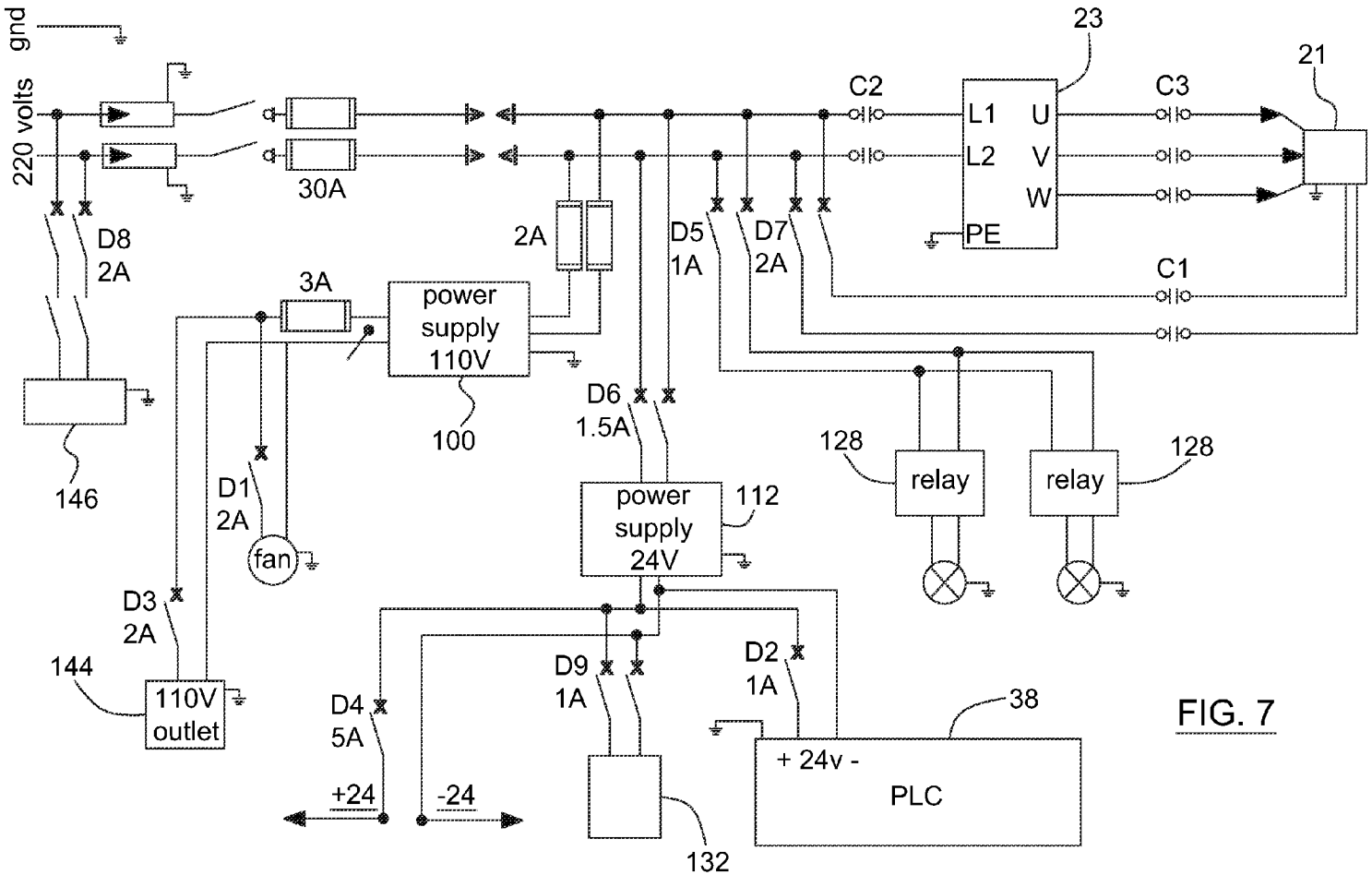
FIG. 7 is a circuit and block diagram of components of the control system of FIG. 1.

With reference to FIGS. 6 and 7, on the electric panel 39, a main switch 104 is located along with an amber light (not shown), indicating whether the system is powered or not.

With reference to FIG. 4, the control console preferably includes direct contact buttons, in order to facilitate its operation. In addition, the control console 64 includes a display 65 allowing a user to visualize and control the motor drive 23 remotely.

The following list of numeral references is provided for FIGS. 1 to 7.

| | |
|---|---|
| 10 | Control system |
| 12 | Back-and-forth cable system |
| 14 | Running cable |
| 16 | First pulley |
| 18 | Second pulley |
| 20 | Controllable motor assembly |
| 21 | Gear motor |
| 22 | Brake |
| 23 | Drive |
| 24 | Carrier |
| 25 | First tracking device |
| 28 | Second tracking device |
| 32 | Storing means |
| 34 | First limit position |
| 36 | Second limit position |
| 38 | Controller |
| 39 | Electric panel |
| 40, 41 | Position counters |
| 42 | Tension sensor |
| 44 | Tension cable |
| 46 | Tensioner |
| 48 | Duration counter |
| 50 | First detector |
| 51 | Mechanical zero |
| 52 | Second detector |
| 53 | Departure position |
| 54 | First proximity detector |
| 56 | Second proximity detector |
| 58 | Metal strip |
| 60 | Monitoring module |
| 62 | Means to detect anomaly |
| 64 | Control console |
| 65 | Display |
| 66 | Signalling light A |
| 68 | Signalling light B |
| 70 | Speaker |
| 72 | Security cable |
| 100 | Power supply 110 V |
| 102 | Protection filter |
| 104 | Main switch |
| 106 | Main fuse |
| 108 | Circuit breakers |
| 110 | Exhaust |
| 112 | Power supply 24 DC |
| 120 | Motor brake contactor C1 |
| | Drive contactor C2 |
| | Motor contactor C3 |
| 122 | Lightening arrester |
| 124 | Terminal block 240 V |
| 126 | Heating switch |
| 128 | Relays |
| 130 | MSR Relay |
| 132 | Internet connection |
| 134 | Counter |
| 136 | Thermostat fan |
| 138 | Main terminal bloc |
| 140 | 24 V fuse |
| 142 | Fan |
| 144 | 110 V outlet |
| 146 | Heating system |
| 148 | Console connector |

The invention also concerns a method of operating the back-and-forth cable system 12, which includes the running cable 14, the pulleys 16, 18 located at both ends of the course for guiding the running cable 14, the controllable motor assembly 20 for driving one of the pulleys 14, 16 and the carrier 24 connected to the running cable 14. This method includes the steps of:

a) generating a first tracking signal indicative of the rotation of the pulley 16 and representative of a first position of the carrier 24;

b) generating a second tracking signal indicative of the rotation of the second pulley 18 and representative of a second position of the carrier 24;

c) storing a first limit position 34 and a second limit position 36 along the course; and d) generating a control signal to invert the rotation of the controllable motor assembly 20 when said positions of the carrier according to steps a) and b) go beyond either one of the limit positions 34, 36, stored in step c).

The method can further includes the steps of resetting the first and the second positions 34, 36 when said two positions 34, 36 of the carrier 24 go beyond either one of the first and second limit positions 34, 36.

According to this method, in step a), the first position of the carrier is updated only when a first predetermined sequence of pulses is detected on the received first tracking signal, and wherein in step b), the second position of the carrier is updated only when a second predetermined sequences of pulses, which can be the same or different than the first sequence, is detected on the received second tracking signal.

It is preferably that in step a), the first position of the carrier is updated only when a first predetermined sequence of pulses is detected on the received first tracking signal, and wherein in step b), the second position of the carrier is updated only when a second predetermined sequences of pulses is detected on the received second tracking signal. This predetermined sequence can be for example P1-P2-P1 for the first tracking device 25 and P3-P4-P3 for the second tracking device 28.

Figure 5:
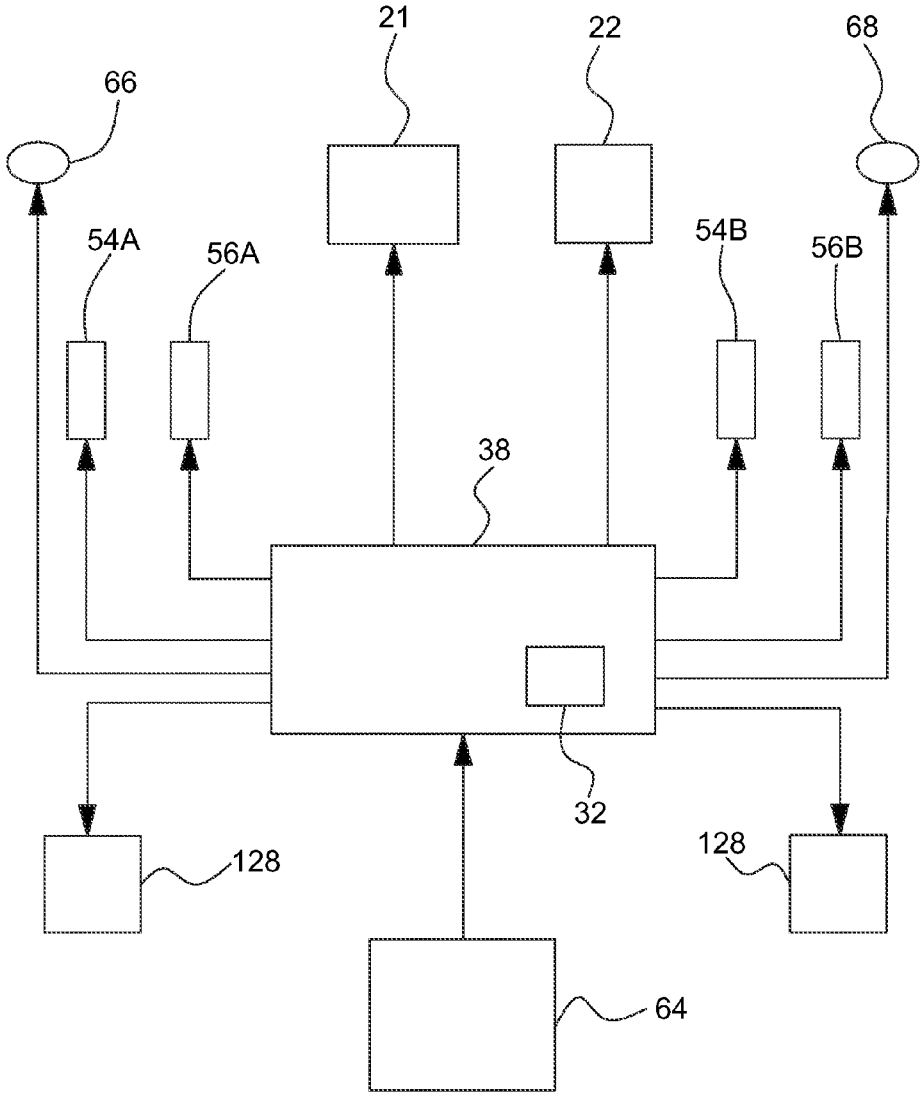
FIG. 5 is a block diagram of components of the control system of FIG. 1.

With reference to FIG. 5, here is an example of a possible sequence of action occurring between the controller 38 and the tracking devices 25, 28. In order to move the carrier between the towers, the control console 64 sends a control signal to the controller 38, including parameters such as speed and direction. The controller 38 receives this control signal and in turn sends a control signal to the drive 23 of the controllable motor assembly 20. The controller 38 also deactivates the motor brake 22. The drive 38 starts the rotation of the motor 21. The controller 38 receives two signals from the sensors 54 and 56 of tower A, the two signals forming the first tracking signal, these two signals being modulated with pulses indicative of the speed of the pulley 16, and thus of the speed of the carrier. The controller 38 also receives two signals of from the sensors 54 and 56 of tower B, these two signals forming the second tracking signal, also modulated with pulses indicative of the speed of the pulley 18. The controller determines a displacement of the carrier 24 based on the information received from the sensors of tower A and another displacement of the carrier 24 from the sensors of tower B. The controller 38 monitors the two displacements and sends a stopping signal to the drive when both displacements have reached a predetermined limit. That is, the controller will wait until both displacement, indicative of the position of the carrier, received from the towers have reached the limit before ordering the drive to invert the rotation of the motor, and/or to activate the brake, even if a pair of sensors 54, 56 may indicate that the position of the carrier is beyond that limit. Once the limit is reached, the difference between the two displacements is corrected by resetting them both. In other words, that in the controller, the displacement calculated from sensors 54, 56 of tower A are used as a reference, and the displacement calculated from sensors 54, 56 of tower B are used as a comparator.

This method preferably includes the steps of monitoring the first and second tracking signals, and to stop the controllable motor assembly 20 when an anomaly is detected on either one of the tracking signals.

According to this method, it is possible to store the first predetermined tension threshold Tmin1 in the storing means 32, to provide a tension signal indicative of a tension of a tension cable 44 of the back-and-forth system 12. An alarm signal is generated when the tension signal is below the first predetermined tension threshold Tmin1. Of course, similar steps can be performed in order to detect an over-tension of the cable 44.

The method also allows for storing a second predetermined tension threshold Tmin2, and to increase the tension in the tension cable 44 when the tension signal detected by the tension sensor 42 is below the second predetermined tension threshold Tmin2. Similarly, it is possible to decrease the tension of the tension cable when the cable is over-tensed.

Advantageously, the method can also include the steps of storing a duration limit, to keep track of a time elapsed since the controllable motor assembly 20 is in operation; and to stop the rotation of the controllable motor assembly 20 when the time elapsed as reached the duration limit. At any time, it is also possible for the operator of the console to reset the duration limit.

The method can also include the steps of storing or saving an acceleration A, a speed S and a deceleration D and three time periods $t_a$, $t_s$ and $t_d$, associated respectively with said acceleration A, speed S and deceleration D. The rotation of the motor is varied so that the controllable motor assembly accelerates at a rate A during the time period $t_a$, turns with said speed S during the time period $t_s$ and decelerates at a rate D during the time period $t_d$, thereby allowing automated riding session.

In order to increase the security of the rider when the system is in operation, the method further includes the steps of detecting the carrier when said carrier is located between the first pulley 16 and the first limit position 34 or between the second pulley 18 and the second limit position 36, and the step of stopping the rotation of the motor 21 when said the carrier is detected.

According to a preferred embodiment of this method, when the system 10 is put in operation, it is recommended to proceed with a validation of the control buttons in manual positions, and to ensure that no alarms or faults are detected. The first operational commands are followed in order to automatically synchronize the departure position. This synchronizing function will establish a mechanical point of synchronization, or mechanical "zero" position 51, corresponding to the location of detector 50. The synchronization is done using the sensors 54, 56 and metal strip 58 of tower A, along with sensor 50 on the departure tower A. The detector 50 is activated by the contact of the carrier 24 in displacement. Once the carrier 24 has contacted the detector 50, the control system 10 will send a control signal to the motor 21 for inverting its direction and will control the position of the carrier 24 automatically by counting the pulses from the departure position 53, which can be at a predetermined location between the sensor 50 and the first limit position 34. The departure position 53 and limit position (or turning points) 34, 36 are pre-determined or pre-established and can be modified according to installation sites.

Operation of the System

The following paragraphs provide information on how the system can be operated, with reference to table 1—Operational commands and table 2—Operational Control Signals, and also to FIGS. 1 and 4.

Using the operational commands No. 2, a sound signal is generated and the departure is controlled automatically. The release of the directional acceleration lever 88 establishes the speed of the carrier displacement. The data related to the manual acceleration set by the lever can be memorized for feature segments.

During the carrier 24 displacements, the control system 10 is able to detect, monitor and analyze the pulses generated by the sensors 54, 56 on each tower, in order to establish the position of the carrier 24. The control system allows an automatic setting of the limit positions 34, 36 (or turning points), which are preferably located towards each end of the course. These turning points 34, 36 are established and pre-programmed according to the specific characteristics of the site.

When a wakeboarder or skier falls during a training session, the operator, controlling the control console 64, using operational commands No. 3, must immediately stop the system 12 at a given position, performing a "positioned stop". When the carrier 24 is stopped, the operator must, using operational commands No. 4, move the carrier 24 in the manual mode in order to bring it closer to the fallen rider. During this operation, the control system 10 will determined the location of the carrier (which was stopped using the "positioned stop" 92 button) in order to determine the direction of the take-off. A light signal (or "on" signal) will automatically be sent to either one of the signalling lights 66, 68, according to the direction in which the carrier will be moved. When the towing cable connected to the carrier is well-tensioned, the boarder advises the operator, using a hand sign, that he is ready to continue the session, and the operator proceed with operational commands No. 5 to set the control system in the automatic mode. A sound signal coming from the control console 64 will be generated prior to each automatic departure, and advising the operator of the imminent departure.

During a back-and-forth cable system session, the speed of the controllable motor assembly 20 is recorded and saved during the first segment of the path. However, at any time, it is possible, using operational commands No. 6, to modify the cruising speed S. Advantageously, the acceleration A and speed S of the carrier can be adjusted according to the experience and age of the boarders.

The time allocated to a back-and-forth cable system session is pre-determined (approximately 8 minutes) and is monitored automatically at the boarder's departure. When the system 10 must be stopped during a session, operational commands No. 7 will allow the operator to reset the counter 48 which counts the time elapsed since the beginning of the session. The control system 10 will send a blinking light signal to the signalling lights 66, 68 in order to advise the boarder of the end of the session. Preferably, the signalling lights 66, 68 will blink during the last segments of the session and the system will bring back the carrier automatically at the departure position 53.

In order to increase the security of the back-and-forth cable system, the operator can, according to circumstances, activate an emergency stop button 93, at any time, using operational command No. 8. When this emergency stop 93 button is activated, the system will immediately cease its operation, and contactors C2 and C3 (on FIGS. 6 and 7) will cut the power to the motor drive 23. Of course, the motor brake 22 must be powered for the correct functioning of the system 10. When the emergency stop 93 is activated, the contactor C1 for the motor brake 22 will cut the powering of the system 10 and the cable system 12 will stop. When the emergency stop 93 is activated or when there is a power cut, this configuration will ensure an immediate stop, taking in account the inertia of the carrier 24.

With reference to FIGS. 6 and 7, a security relay 130, preferably an MSR relay from Rockwell Automation controls the elements to put the system 10 back in operation. The operator must put the system back in operation using operational commands No. 9.

Resetting the system 10 is made directly on the electric panel 39. This ensures that there is no remaining residual current.

Preferably, the control system 10 includes a proximity cable 72 connected or linked to the operator. In other words, an operator needs to be connected to its control console 64 in order to operate the system 10. This security procedure ensures that the operator will not wander away from the control console 64 and will be ready to intervene at any time during a training session. If the security cable 72 is disconnected, the system 10 will be stopped automatically (operational command No. 11).

The control console 64 transmits to the operator, through the lighted buttons of the console: Proximity Stop 82; Rearm 90; Positioned Stop 92 and Emergency Stop 93, control signals and faults. Table 2 provides more information on the functioning of console buttons. Preferably, green lighted buttons confirm the different functional operation of the system and green and red lighted buttons allow the operator to diagnose rapidly anomalies of the system during its functioning.

TABLE 1

Operational commands (with reference to FIG. 4)

| Functions | Actions |
|---|---|
| No. 1. Synchronization (System in "stop-off" mode) | Put the MODE button in "MAN" position, activate and maintain the "rearm selector" button, maintain the blue button "rearm" during 3 seconds. |
| No. 2. Automated departure (System in "stop-off" mode) | Put the MODE button in "AUTO" position, place the lever towards "frontward" and let go of the lever when the desired speed is reached. |
| No 3. Positioned stop (System in "on" mode) | Push the red button "positioned stop". |
| No 4. Manual displacement (System in "stop-off" mode) | With the MODE button in "MAN" position and using the lever, select either "frontward" or "backward" and maintain the lever position until the carrier has reached the desired position. Release the lever once the desired position is reached. |

TABLE 1-continued

| Operational commands (with reference to FIG. 4) | |
|---|---|
| Functions | Actions |
| No 5. Automatic restart (System in "stop-off" mode) | Place the MODE button in "AUTO" position, the system will then perform to an automated take-off to the predetermined speed. |
| No 6. Speed adjustment (System in "stop-off" mode) | Put the MODE button in "0" position, maintain the blue button "rearm" during 3 seconds. A fast blinking of the green button "rearm selector" confirms the command. To re-establish an automated departure, proceed with function no. 2 |
| No 7. Time resetting (System in "stop-off" mode) | Put the MODE button in "MAN" position; maintain the blue button "rearm" during 3 seconds. A fast blinking of the green button "rearm selector" confirms the command. To re-establish the automated departure, proceed with function no. 5 |
| No 8. Emergency stop (System in "on" mode) | Activate the red button "emergency stop". This button will stay pushed and lighted. |
| No 9. Deactivation of the emergency stop (System in "stop-off" mode) | Pull the lighted red button "emergency stop". The system can be restarted by pushing the lighted blue button "rearm system" located on the electric panel. The lights of these two buttons ("emergency stop" and "rearm system") are off when the system is OK. |
| No 10. Turning points adjustment (System in "stop-off" mode) | Use the display of the controller (PLC) to visualize the turning points. Put the MODE button in "0" position. With the "key" button, select the limit position to modify. The selection is made by maintaining the key on either one of towers "A" or "B". With the lever, increase or decrease the position of the limit positions (or turning points) using: "FRONTWARD" = +1 and "BACKWARD" = −1 for each push of the lever. |
| No 11. Proximity cable stop (System in "on" mode) | Disconnecting the proximity cable results in an immediate stop of the system. Reconnect the security cable and press the blue button "rearm" to put the system back on. Use functions No 4 and 5 to put the system back in operation. |

TABLE 2

| TAC 1400 - Operational control signals (with reference to FIG. 4) | |
|---|---|
| Light Signals | Signaling Function |
| Green light MAN AUTO (84) always on. | The carrier moves frontwards or backwards. |
| Green light MAN AUTO (84) blinks slowly. | The system is ready for start-off. |
| Green light MAN AUTO (84) blinks rapidly. | Speed must be adjusted with lever. Function no. 2. |
| Green light "rearm selector" (86) blinks rapidly. | Confirms a speed change or a time reset. |
| Green light "rearm selector" (86) always on and red light "positioned stop" (92) always on. | Electrical panel temperature pre-alarm. (Panel ventilation must be checked.) |
| Green light "rearm selector" (86) blinks slowly and red light "positioned stop" (92) always on. | Tension of towers A and B pre-alarm. (Tension cables A or B must be checked and adjusted if needed.) |
| Green light "rearm selector" (86) always on and red light "positioned stop" (92) blinks rapidly. | Electrical panel temperature alarm. The system stops and goes back to the departure position. (Ventilation of electric panel must be checked.) Once the problem is solved, use functions no. 7 and 2. |
| Red light "positioned stop" (92) always on. | Alarm for tensions of towers A and B. The system is stopped and the carrier is moved to the departure position. (Tension of tension cables A or B must be checked and adjusted if required.) Once the problem is solved, use functions no. 7 and 2. |
| Red light "positioned stop" (92) blinks slowly. | The "positioned stop" button has been activated, the control system is waiting for an operational command. |
| Red light "positioned stop" (92) blinks rapidly. | The proximity cable is disconnected. Reconnect proximity cable and use functions no. 4 and 5. |
| Red lights "positioned stop" (92) and "emergency stop" (93) blink rapidly. | False pulse detection alarm. Use functions no. 4 and 1. (Verify sensors.) |
| Red light "emergency stop" (93) always on. | "Emergency stop" activated or system must be rearmed on the electric panel. |

TABLE 2-continued

| TAC 1400 - Operational control signals (with reference to FIG. 4) | |
|---|---|
| Light Signals | Signaling Function |
| Red light "emergency stop" (93) blinks slowly. | Carrier detectors 50 or 52 alarm. Use manual functions to move the carrier. |
| Red light "emergency stop" (93) blinks rapidly. | Indicates an alarm on the drive. Verify display and rearm using "reset" function. |
| Sound signal warning (70) | A sound signal will be emitted before an automated take-off. |

With reference to FIGS. 1, 6 and 7, the control system 10 is an automated back-and-forth cable system for water-skiing and wakeboarding. The system has an electric panel 39 which uses a 220 volts single phase 40 ampere entry, advantageously eliminating the need of using generators, transducers or transformers such as required for a 460 volts 3 phases entry, as commonly used on existing systems.

Having a control system 10 working on a two phase-220V requires a proper balancing of the phases, proper protection filters to prevent and peaks of voltage on the phases, and an oversized drive for controlling the motor, in order to be able to manage the power needs of the system.

The control system 10 includes a programmable controller 38, for allowing an automated or manual control of the system, based on the selection made on a remote control console 64 using the MODE button 84, a feature not available on existing back-and-forth cable systems.

The programmable controller 38 allows controlling the departure of a boarder with a given acceleration A in order to reach a predetermined speed S. This predetermined speed S can be varied according to the experience of the boarder. The speed is saved automatically for future back-and-forth sequence. This predetermined speed S can be erased and modified at any time during a session using the operational function No. 6.

Using the controller 38, it is also possible to control the limit positions at two extremities of the course along which the boarder can be pulled. In other words, the controller 38 allows the modification of the positions of the turning points. An analysis of the pulses allows to obtain a sequential logic and precise turning points using this automated turning function.

The controller 38 is able to monitor the pulses detected, and analyze the difference between these pulses, such that it can proceed with a correction in order to re-establish the turning points, using an automated correction function.

The turning points 34, 36 can be memorized in the controller 38. It is also possible to move them using an operational function in order to increase the length along which the boarder is pulled. The turning points can be moved using a manual correction function such that they can be adjusted according to different installation sites.

The controller 38 can monitor the pulses received such that a defect on the pulse signal can be detected at the control console. When a defect or anomaly on the pulse signal is detected, the system will be stopped automatically and will move the carrier 24 using manual operational functions at low speed to finish the segment. This pulse signal analysis ensures a better security and control over the position of the carrier on the back-and-forth systems.

Still using the controller 38, it is possible to control and modify the time allocated for a back-and-forth session. Such function allows the operator to focus on secure back-and-forth sequences of the boarder without worrying about the time elapsed since the beginning of the session. This control of the time elapsed for a session is realized using an integrated timer or counter.

By accessing this timer through the controller 38, an operator can reset the time elapsed for a session to "zero" using an operational function called "time rearm".

The controller and the timer allow having the signalling lights automatically blink on the towers in order to advise the operator and boarder that the end of the session is approaching. Preferably, red lights are installed at mid-height of the towers in order to give the boarder an indication of the end of the session. Following this blinking signal, the carrier will be brought back automatically to the departure position, realized using the "automated stop function".

The controller and the signalling lights on the towers allow for a better control of the system when a boarder falls in the water. The controller allows the operator to stop the segment using the control console and a function called "positioned stop". The system will establish automatically the direction of the carrier either in a "frontward" or "backward" direction. The light on the tower towards which the carrier will be directed will be lighted. This prevents any confusion of the boarder since you will note, by looking at the signalling lights, in which direction the carrier will move. This function renders the operation of the system more secure.

In addition, the system 10 includes carrier detectors, such as proximity switches, at both ends of the course. A proximity detector is installed near each one of the towers in order to indicate that the carrier has gone beyond the pre-established limits in between which the carrier is to be moved. When such situation arises, the detector will send a signal to the controller 38, which will stop automatically the system 12 and transmit an alarm to the control console 64. These detector 50, 52 and this function prevent the carrier 24 from crashing in either one of the towers, would a defect on the system occur. When the detector is activated, operational functions will move the cable in manual mode at low speed in order to re-establish synchronization with the detectors 50 and 52.

The controller can, using the pulse sensors 54, 56 and the carrier detector 50 of tower A, establish a synchronization position 51 with the carrier 24. A mechanical "zero" point 51 can thus be established for synchronizing the automated system 10 and the mechanical displacement of the carrier 24.

Preferably, the control console 64 is provided with a security cable 72 and proximity switch which ensures that, in the event that the operator moves away from the control console 64, the system will be stopped. By using such proximity switch, the operator of the system must stay connected to its control console at any time.

Both the electric panel 38 and the control console 64 are provided with an emergency stop. When the emergency stop is activated, contactors C2 and C3, which control the power supply of the system, will cut the power before and after the drive. Once the emergency stop has been activated, the operator cannot start back the system 10 without first rearming the system on the electric panel 38. These operational functions for putting back the cable system in operation are controlled using the security relay MSR. This setup ensures a high level of security.

Preferably, the control console 64 is provided with a display 65 for displaying the speed of the drive 23. The display allows visualizing the speed of the carrier 24 and thus allows to control it using the speed drive function on the control console 64. This characteristic of the system 10 increases the control an operator can have on the automated system remotely.

The control console 64 is provided with a speaker in order to be able to emit a sound signal when the system is put in operation automatically. Once the system has checked that all conditions are met in order to proceed with an automated take-off, the sound signal will be emitted prior to the take-off in order to advise the operator of an imminent departure.

Preferably, the electric panel 38 is provided with a temperature controller 126 and heating system 146 in order to maintain an appropriate temperature for the correct functioning of the system 10. A pre-alarm will advise the operator through the control console 64 if a temperature increase arises, and an alarm will prevent the system from operating when such temperature detected is too high. These features prevent overheating of the system 10 during the summer and increase the liability of electrical components of the system.

Preferably, the electric panel 38 is provided with a heating system 146 required for example in regions having winters.

Also preferably, the panel 38 is designed such that even when the power supply is cut, the temperature control of the system will be maintained. The heating system 146 will allow to keep the electrical and electronic components of the electric panel 38 at their operating temperature in order to ensure a correct functioning of the system.

Still preferably, the system 10 is also provided with electronic tension sensors 42 installed on the tension cables 44 of the towers. These sensors 42 continuously transmit tensing signals indicating the tension of the tension cables 44 when the system is in operation. A pre-alarm advises the operator when the tension of the tension cable 44 is below a predetermined threshold. The cable will need to be tensed in order to deactivate this pre-alarm. The system will stop working if an alarm indicates that the tension of the tension cable is below another predetermined tension threshold. The tension sensors allow prevention the stretching of the cables 44. They also ensure that a constant tension is applied on the back-and-forth cable system 12.

Preferably, the motor 21 used for the back-and-forth cable system is a 7.5 HP motor gear. This motor gear preferably includes a 220 volts brake 22. The breakage control is done using a high-efficiency contactor C3 located in the electric panel 38. When the brake 22 is powered, it can be disengaged or not in order to free the rotation of the motor. This setup renders the system very secure. When a power outage or an electric default occurs, the cable system 12 will be brake automatically, even if running at high speed. This feature prevents the carrier 24 from crashing into the towers.

Preferably, the electric panel 38 includes a protection filter 102 for the electric supply of the system. This power filter 102 regulates or stabilizes the voltage and protects the system from lightening, using light arresters 122.

Also preferably, the system is provided with a remote communication system 132. This system can be done using a telephone line and a modem in order to communicate with the controller 38 and the drive 23 remotely. This communication system 132 allows to diagnose problems at any time regardless of the location of the installation. This communication system 132 allows to remotely monitor the good functioning of the system, and to proceed with preventive maintenance and troubleshooting of the system, if required.

Still preferably, the control console 64 can easily be disconnected from the electric panel 38 when the cable system is shut off for an extended period of time. This ensures that the control console be stored in a controlled environment, apart from the electric panel 38.

While throughout this description a boarder is cited in example, the system could be used by a skier or any other type of person needed to be pulled or towed by a back-and-forth cable system.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A control system for a back-and-forth cable system that includes a running cable, a first pulley and a second pulley, the pulleys being located at both ends of a course for guiding the running cable, a controllable motor assembly for driving one of the pulleys and a carrier connected to the running cable, the control system comprising:

a first tracking device, associated with the first pulley, for generating a first tracking signal indicative of a rotation of said first pulley;

a second tracking device, associated with the second pulley, for generating a second tracking signal indicative of a rotation of said second pulley;

storing means for storing a first and a second limit positions along the course; and a controller having inputs for receiving the first and the second tracking signals which are representative of positions of the carrier, said controller generating a control signal to invert rotation of the controllable motor assembly when said two positions of the carrier detected respectively by the first and second tracking devices go beyond either one of the two limit positions.

2. The control system according to claim 1, wherein the controller further comprises two position counters, each of said position counters being associated with a corresponding one of the positions of the carrier, the controller resetting the position counters when said two positions of the carrier go beyond either one of the first and second limit positions.

3. The control system according to claim 1, wherein said storing means are also for storing a first predetermined tension threshold, and the control system further comprises a tension sensor being associated with a tension cable of the back-and-forth system for monitoring a tension of the tension cable, the tension sensor having an output for sending a tension signal indicative of said tension, the controller having an input for receiving said tension signal and an output for generating an alarm signal when the tension is below the first predetermined tension threshold.

4. The control system according to claim 3, wherein said storing means are also for storing a second predetermined tension threshold, and the control system further comprises a controllable tensioner for tensing the tension cable of the back-and-forth system, the controller having an output for sending a tension control signal, the tensioner having an input for receiving said tensing control signal, the controller sending a tensing control signal to the tensioner when the tension of tension cable is below the second predetermined tension threshold, for increasing a tension in said tension cable.

5. The control system according to claim 1, wherein the storing means are also for storing a duration limit, and wherein the controller further comprises a duration counter for keeping track of a time elapsed since the controllable motor assembly is in operation, said controller generating a control signal to stop rotation of the controllable motor assembly when said time elapsed is equal to the duration limit.

6. The control system according to claim 1, wherein the storing means are also for storing an acceleration A, a speed S and a deceleration D, and three time periods $t_a$, $t_s$ and $t_d$, respectively associated with said acceleration A, speed S and deceleration D, the controller generating a control signal to vary the rotation of the controllable motor assembly so that the controllable motor assembly accelerates at a rate A during the time period $t_a$, turns with said speed S during the time period $t_s$ and decelerates at a rate D during a time period $t_d$.

7. The control system according to claim 1, further comprising a first and second detectors for detecting a presence of the carrier, the first detector being located between the first pulley and the first limit position and the second detector being located between the second pulley and the second limit position, the controller sending a control signal to the controllable motor assembly for stopping the rotation of the motor when said presence of the carrier is detected by either one of the first and second detectors.

8. The control system according to claim 1, wherein the first and second tracking devices each includes a first proximity detector, a second proximity detector and a metal strip, said first and second proximity detectors being mounted on a frame supporting the corresponding pulley, the metal strips being affixed respectively to said pulleys, the first tracking signal forming a pulse P1 when the first detector of the first tracking device detects the corresponding metal strip, and a pulse P2 when the second detector of the first tracking device detects the corresponding metal strip, the second tracking signal forming a pulse P3 when the first detector of the second tracking device detects the corresponding metal strip and a pulse P4 when the second detector of the second tracking device detects the corresponding metal strip.

9. The control system according to claim 1, wherein the controller further comprises a monitoring module having means for monitoring the first and second tracking signals, and means for detecting an anomaly on the first and second tracking signals, the controller generating a control signal to the controllable motor assembly to stop the controllable motor assembly when said anomaly is detected on either one of the tracking signals.

10. The control system according to claim 1, further comprising a control console connected to the controller and to the storing means, for allowing a user to modify values stored in the storing means.

11. The control system according to claim 1, further comprising two signaling lights located respectively at said both ends of the course, the controller generating an ON signal to the corresponding one of the two signaling light towards which the carrier is heading.

12. The control system according to claim 10, wherein the control console further comprises a speaker for generating a sound signal, the controller generating a sound control signal to the speaker of the control console when the controllable motor system assembly is put in operation.

13. The control system according to claim 10, further comprising a security cable connectable between an operator and the control console, the controller generating a control signal to stop the controllable motor assembly when the security cable is no longer connected to the console.

14. A method of operating a back-and-forth cable system including a running cable and pulleys located at both ends of a course for guiding the running cable, a controllable motor assembly for driving one of the pulleys and a carrier connected to the running cable, the method comprising the steps of:

a) generating a first tracking signal indicative of a rotation of said first pulley and representative of a first position of the carrier;

b) generating a second tracking signal indicative of a rotation of said second pulley and representative of a second position of the carrier;

c) storing a first limit position and a second limit position along the course; and d) generating a control signal to invert a rotation of the controllable motor assembly when said positions of the carrier according to steps a) and b) go beyond either one of the limit positions, stored in step c).

15. The method according to claim 14, further comprising the steps of resetting the first and the second positions when said two positions of the carrier go beyond either one of the first and second limit positions.

16. The method according to claim 14, further comprising the steps of:

i) storing a first predetermined tension threshold;

ii) providing a tension signal indicative of a tension of a tension cable of the back-and-forth system; and iii) generating an alarm signal when the tension signal is below the first predetermined tension threshold.

17. The method according to claim 16, further comprising the steps of:

iv) storing a second predetermined tension threshold; and v) increasing the tension in said tension cable when the tension signal of step ii) is below the second predetermined tension threshold.

18. The method according to claim 14, further comprising the steps of:

i) storing a duration limit;

ii) keeping track of a time elapsed since the controllable motor assembly is in operation; and iii) stopping rotation of the controllable motor assembly when said time elapsed is equal to the duration limit.

19. The method according to claim 14, further comprising the steps of:

i) storing an acceleration A, a speed S and a deceleration D and three time periods $t_a$, $t_s$ and $t_d$, associated respectively with said acceleration A, speed S and deceleration D; and ii) varying the rotation of the controllable motor assembly so that the controllable motor assembly accelerates at a rate A during the time period $t_a$, turns with said speed S during the time period $t_s$ and decelerates at a rate D during the time period $t_d$.

20. The method according to claim 14, further comprising the steps of:

i) detecting a presence of the carrier when said carrier is located between the first pulley and the first limit position or between the second pulley and the second limit position; and ii) stopping the rotation of the motor when said presence of the carrier is detected in step i).

21. The method according to claim 14, wherein in step a), the first position of the carrier is updated only when a first predetermined sequence of pulses is detected on the received first tracking signal, and wherein in step b), the second position of the carrier is updated only when a second predetermined sequences of pulses is detected on the received second tracking signal.

22. The method according to claim 14, further comprising the steps of:

i) monitoring the first and second tracking signals; and ii) stopping the controllable motor assembly when an anomaly is detected on either one of the tracking signals.

* * * * *